United States Patent [19]

Chevalier

[11] 4,390,229

[45] Jun. 28, 1983

[54] PLUG-IN CONNECTOR SUITABLE FOR USE IN A FLUID MEDIUM

[75] Inventor: André Chevalier, Pantin, France

[73] Assignee: Institut Francais du Petrole, Rueil-Malmaison, France

[21] Appl. No.: 237,213

[22] Filed: Feb. 23, 1981

[30] Foreign Application Priority Data

Feb. 22, 1980 [FR] France ..... 80 04028

[51] Int. Cl.[3] ..... H01R 13/44; H01R 13/52

[52] U.S. Cl. ..... 339/115 R; 339/117 R

[58] Field of Search ..... 339/94 R, 94 C, 115 R, 339/115 C, 117 R, 117 P

[56] References Cited

U.S. PATENT DOCUMENTS

| | | | |
|---|---|---|---|
| 3,508,188 | 4/1970 | Buck | 339/94 C |
| 3,641,479 | 2/1972 | O'Brien et al. | 339/94 R |
| 3,729,699 | 4/1973 | Briggs et al. | 339/94 R |
| 3,845,450 | 10/1974 | Cole et al. | 339/117 R |
| 4,039,242 | 8/1977 | Wilson et al. | 339/117 P |
| 4,172,770 | 10/1979 | Semersky et al. | 435/291 |
| 4,174,875 | 11/1979 | Wilson et al. | 339/117 P |
| 4,188,084 | 2/1980 | Buresi et al. | 339/117 R |

FOREIGN PATENT DOCUMENTS

| | | | |
|---|---|---|---|
| 1490351 | 7/1967 | France . | |
| 792381 | 12/1980 | U.S.S.R. | 339/117 R |

*Primary Examiner*—John McQuade
*Assistant Examiner*—Gary F. Paumen
*Attorney, Agent, or Firm*—Millen & White

[57] ABSTRACT

A connector comprises at least one plug for mating with a bore of a corresponding socket. A main chamber contains protecting fluid communicating with the bore, the volume of this chamber automatically varying to fill the bore with protecting fluid when the plug is withdrawn from the bore. The connector further comprises a compensation chamber filled with a protecting product, such as grease, under a pressure higher than the pressure prevailing in the main chamber. Upon withdrawal of the plug from the socket, a predetermined amount of protecting product is transferred from this compensation chamber to the assembly formed by the main chamber and the bore of the socket.

10 Claims, 10 Drawing Figures

PLUG-IN CONNECTOR SUITABLE FOR USE IN A FLUID MEDIUM

BACKGROUND OF THE INVENTION

The present invention relates to a plug-in connector which is suitable for use in a fluid medium. In the following, reference will be made, by way of non-limitative example only, to an electric connector whose contact elements are protected against the surrounding medium, so that electrical connections can be established and interrupted even if the connector is immersed in a liquid medium which may be electrically conductive.

Different types of connectors are already known which are specially designed so that the plug and socket constituting the connector can be assembled when submerged in a liquid.

One of these connectors, which is described in French Pat. No. 1 490 351, uses a fluidtight diaphragm which protects the electrical contacts of the socket. When the electrical connection is established, the plug pierces the diaphragm and thus destroys it. Consequently, only one operation of plug and socket connection can be effected under water. Such a connector is therefore unsuitable when electrical connection must be established and interrupted several times in a liquid medium.

In order to obviate this drawback other connectors have been built in which the electrical contacts of the socket are protected by a suitable liquid. A retractable piston holds this liquid in the socket and expels this liquid into a special space provided therefor, as the plug is inserted into the socket. U.S. Pat. No. 3,508,188, U.S. Pat. No. 3,845,450, U.S. Pat. No. 4,039,242 and U.S. Pat. No. 4,172,770 illustrate two embodiments of this type of connector which can be operated several times while remaining under water.

The drawbacks of these last-mentioned devices result from the fact that, every time the connector is operated, a certain amount of the protecting liquid is discharged from the socket. Moreover, when solid particles are in suspension in the liquid where the connector is immersed, experience shows that a larger or lesser amount of these particles penetrates into the socket and causes a more or less rapid deterioration of the connector.

The present invention provides a new electrical connector which does not suffer from the above-indicated drawbacks.

BRIEF DESCRIPTION OF THE DRAWINGS

The invention will be more readily understood and its advantages clearly made apparent from the following description of non-limitative embodiments of the drawings, wherein.

DETAILED DISCUSSION OF THE INVENTION

Figure 1A:
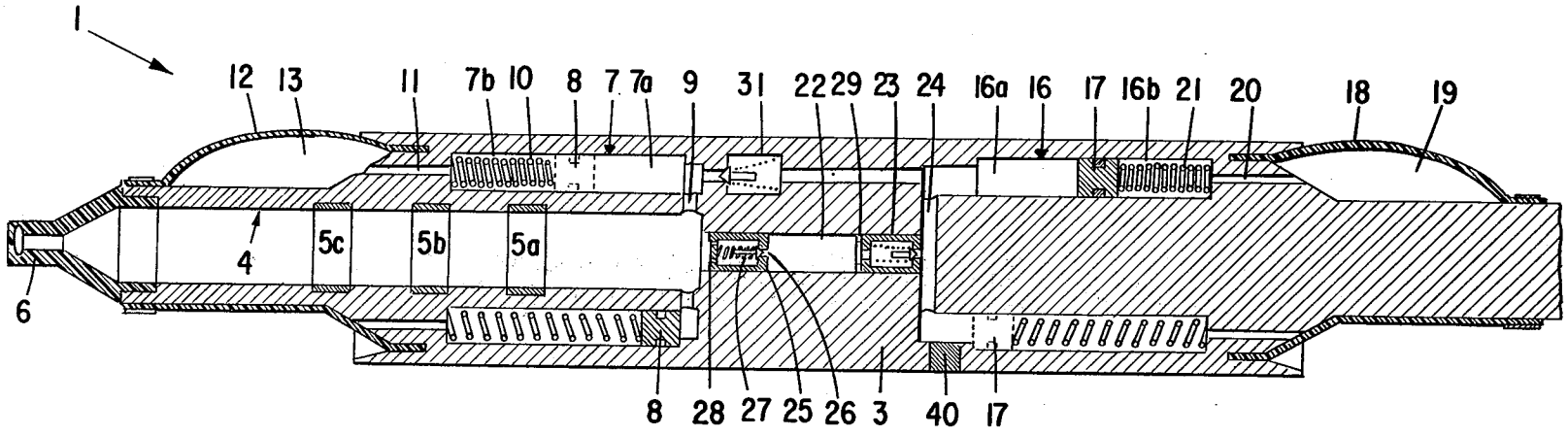
FIGS. 1A and 1B diagrammatically show a cross-section of a first embodiment of socket and plug assembly constituting a connector according to the invention.
Figure 1B:
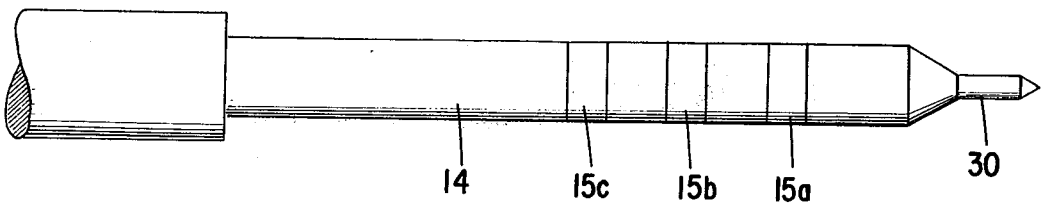

FIGS. 1A and 1B diagrammatically illustrate a first embodiment of a socket 1 and of a plug 2.

The socket 1 is, for example, connected to an apparatus such as a wellhead immersed on the water bottom. This socket comprises a body member 3 provided with a bore 4 adapted to receive the plug 2. In the bore 4 are housed electrical rings or studs 5*a*, 5*b*, 5*c*. Three co-axial electrical studs have been shown by way of example, this number being by no way limitative. These electrical contacts 5*a*, 5*b*, 5*c* are connected to electrical conductors which have not been shown for clarity of the drawing. Similarly, constructional details which are conventional in the art have not been illustrated.

The free end of the socket is equipped with an obturator which will be described below in detail.

The body 3 of the socket is provided with a main chamber 7 which is here of annular shape. A piston 8 is displaceable in this chamber, thus defining a space 7*a* which permanently communicates with the bottom of the bore 4 through channels 9, and a space 7*b* housing a calibrated spring 10 acting on the piston 8. Through channels 11 which open in the space 7*b* and outside the body 3 the external hydrostatic pressure is applied to the piston 8. Since the socket must be adapted for use in a liquid medium wherein solid particles may be suspended, a flexible membrane 12, secured to the body 3, delimits a close space 13 wherein the channel 11 actually opens.

The hydrostatic pressure in the surrounding medium is then transmitted to the piston 8 through the membrane 12 and via a liquid, such as oil, which fills the closed space 13 and the space 7*b* of the main chamber 7.

The space 7*a* of the chamber 7 and the bore 4 of the socket are filled with an insulating grease for protecting the electrical contacts 5*a*, 5*b*, 5*c* when the plug 2 is not inserted in the socket 1. The piston 8 is then in the position shown in solid line at the lower part of FIG. 1A.

The plug 2 diagrammatically shown in FIG. 1B comprises a cylindrical part, or pin 14, mating with the bore 4 of the socket 1 and provided with electrical terminals 15*a*, 15*b*, 15*c* corresponding respectively to the contacts 5*a* to 5*c* of the socket 1.

During the introduction of the plug 2, substantially the whole amount of the grease contained in the bore 4 is expelled through the channels 9 into the space 7*a* of the main chamber 7, thus displacing the piston 8 to the position shown in dotted line at the upper part of FIG. 1A.

Theoretically such a connector can be indefinitely operated, provided that at each withdrawal of the plug the whole amount of grease remains in the socket. Actually, in spite of the provision of the obturator 6 a greater or lesser amount of grease sticks to the plug 2 and is thus extracted from the socket when the two parts of the connectors are separated.

To obviate this drawback the socket 1 is provided with a compensation chamber 16 which, in the illustrated embodiment, is of annular shape and comprises a displaceable piston 17 dividing the compensation tank into a space 16*a* filled with grease and a space 16*b* filled with a liquid such as oil, subjected to the hydrostatic pressure of the external medium by means of a flexible membrane 18 which defines around the socket body a sealed space 19 communicating with the space 16*b* through channels 20.

A gauged spring 21 urges the piston 17 in the direction corresponding to a volume reduction of the space 16*a*. Means are provided for transferring, if necessary, a certain amount of grease from the compensation chamber 16*a* to the assembly of the main chamber 7*a* and the bore 4.

FIG. 1A shows a mechanical embodiment of this transfer means which essentially comprises a duct 22 having one end connected with the bore 4 and the other end with the compensation tank 16*a* through a stationary non-return valve 23 and channels 24.

The non-return valve 23 is so positioned as to permit the grease transfer from the compensation chamber 16*a* into the duct 22 under conditions which are indicated below.

The duct 22 houses a sliding piston 25 traversed by a bore 26 which opens on both sides thereof. A non-return valve 27 prevents grease from flowing into the compensation chamber 16*a*. Stop members 28 and 29 limit the displacements of the sliding piston 25 within the duct 22.

The plug 2 is extended by an operating rod 30 of suitable length and of a diameter which is substantially smaller than that of the duct 22.

When the device is put into operation the compensation chamber 16*a*, the bore 4 and the duct 22 are filled with grease before the connector immersion. The pistons 8 and 17 are in the positions shown in solid line in FIG. 1A and the sliding piston 25 is in contact with the stop member 28.

Connection of the plug 2 and socket 1 is effected as above indicated, using a suitable apparatus which moves the two connector parts towards each other, or by a diver.

The plug 2 is inserted into the socket 1. The cylindrical part 14 of the plug acts as a piston and expels grease into the main chamber 7. The piston 8 moves towards the left side of FIG. 1A, then the operating rod 30 comes into contact with the sliding piston 25 on which this rod exerts an increasing force until the pressure in the portion of the duct 22 between the piston 25 and the non-return valve 23 increases to open the valve 27.

When the plug 2 is completely inserted in the socket 1 the grease filling the portion of the duct 22 comprised between the piston 25 and the non-return valve 23 is displaced into the portion of the duct 22 which directly communicates with the bore 4, the piston 8 is in the position shown in dotted line at the upper part of FIG. 1A and the electrical studs 5*a*, 5*b*, 5*c* are in contact with the terminals 15*a*, 15*b*, 15*c* respectively and the piston 25 had been displaced in the duct 22 and is possibly in contact with the stop member 29. The valve 27 is closed again because the pressure drop is no longer sufficient to keep it open.

Locking means (not shown) hold the two parts of the connector in contact with each other.

When the plug 2 is extracted from the socket 1, the free space left by the cylindrical pin 14 is automatically filled by the grease expelled from the chamber 7*a* under the action of the piston 8 which is displaced by the spring 10 until it comes in the abutment position shown in dotted line in the lower part of FIG. 1A.

Simultaneously under the action of the higher pressure prevailing in the compensation chamber 16, the valve 23 opens, thus leaving a passage to the grease which repels the piston 25, the gauged value of the valve 27 is such that it maintains it closed, and fills the portion of the duct 22 comprised between the piston 25 and the valve 23. This displacement of the piston 25 causes injection of a determined grease amount into the bore 4. This amount is equal to the volume of the duct 22 comprised between the valve 23 and the piston 25 when the latter is in its position shown in FIG. 1A. This grease amount has been selected at least equal to the grease volume extracted by the plug 2 and is preferably sufficient to cause a small quantity of grease to be discharged from the socket 1 through the obturator 6 as the plug 2 is withdrawn, so that any external liquid or solid element is prevented from penetrating into the socket 1 as the plug 2 is withdrawn.

To compensate for such grease transferring, the piston 17 is subjected to a slight displacement towards the left side of FIG. 1A. When, after multiple connecting and disconnecting operations the piston 17 has reached his position shown in dotted line in FIG. 1A, it becomes necessary to fill again the compensation chamber 16*a*, using a suitable tool which can be adapted to the greaser diagrammatically shown at 40. This operation may be performed after the socket 1 has seen raised back to the water surface, or while leaving this socket immersed.

In the case where the plug 2, after its withdrawal from the socket 1, is again inserted thereinto, there is provided a gauged valve 31 which connects the main chamber 7*a* with the chamber 16*a* and limits pressure rise in the main chamber by recycling a part of the grease into the compensation chamber 16*a*.

As it will be apparent to those skilled in the art, the provision of the membranes 12 and 18 makes it possible to use the connector at any depth. However it would be possible, without departing from the scope of the present invention, to substitute rigid walls for these membranes, the force necessary for moving the two parts of the connector towards each other thus being dependent on the depth of immersion and on the characteristics of the spring 10, which may be replaced by a pressurized gas.

Figure 2A:
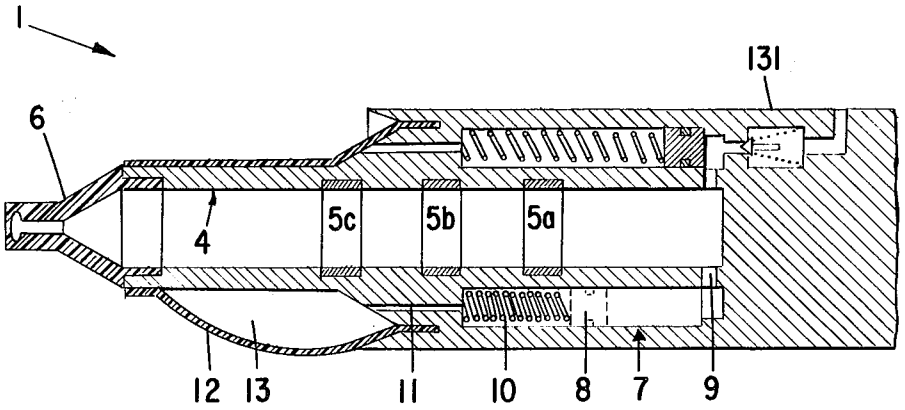
FIGS. 2A and 2B illustrate a second embodiment of the invention, FIGS. 3A and 3B diagrammatically show a third embodiment, FIGS. 4A to 4D relate to the construction of an obturator secured to the end of the socket.
Figure 2B:
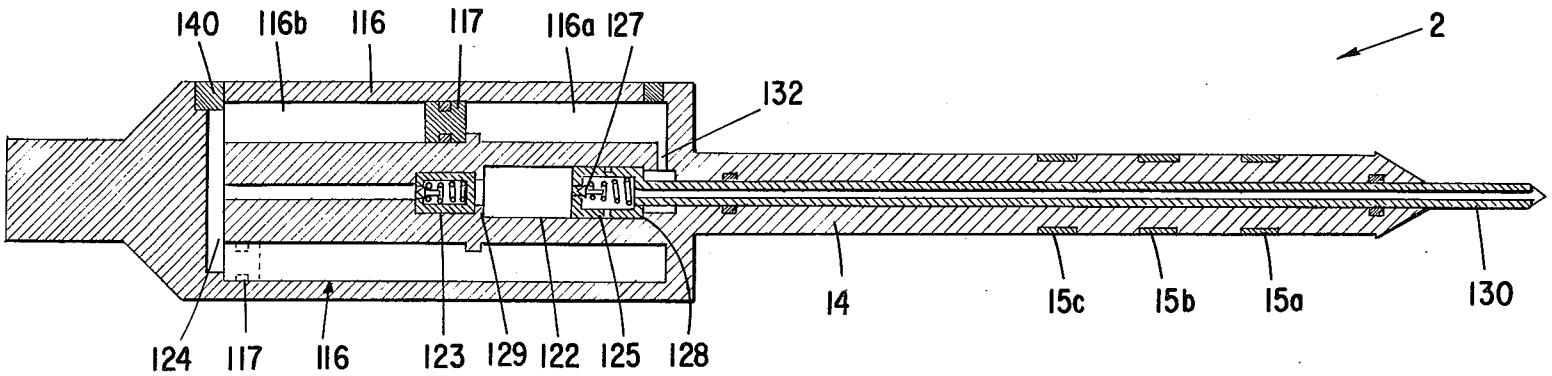

FIGS. 2A and 2B illustrate an embodiment wherein the compensation chamber is incorporated to the plug 2 which is diagrammatically shown in cross-section in FIG. 2B.

The plug comprises a duct 122 which communicates via a gauged valve 123 and ducts 124 with the compensation chamber 116 having a compartment 116*b* filled with grease. In this embodiment the piston 117 is subjected to the action of a pressurized gas contained in the compartment 116*a*.

The duct 122 slidably houses a piston 125 provided with a calibrated non-return valve 127 and extended by a hollow operating rod 130 which protrudes from the end of the plug 2. In order to make the force displacing the piston 125 independent from the immersion depth of the socket 1, the pressure of the gas filling the compartment 116*a* of the chamber 116 is simultaneously applied to the piston 125 via a duct 132.

The operation of the connector is substantially the same as above. The non-return valve 131 connects the main chamber 7 to the surrounding water to limit the pressure if necessary by releasing grease in excess from the compensating chamber. In this embodiment the excess of grease is lost. The advantage of this embodiment lies in an easier filling of the compensation chamber 116 since, after separation of the two parts of the connector, the plug 2 is generally raised to the water surface where the compartment 116*b* can optionally be filled through the greaser 140.

Figure 3A:
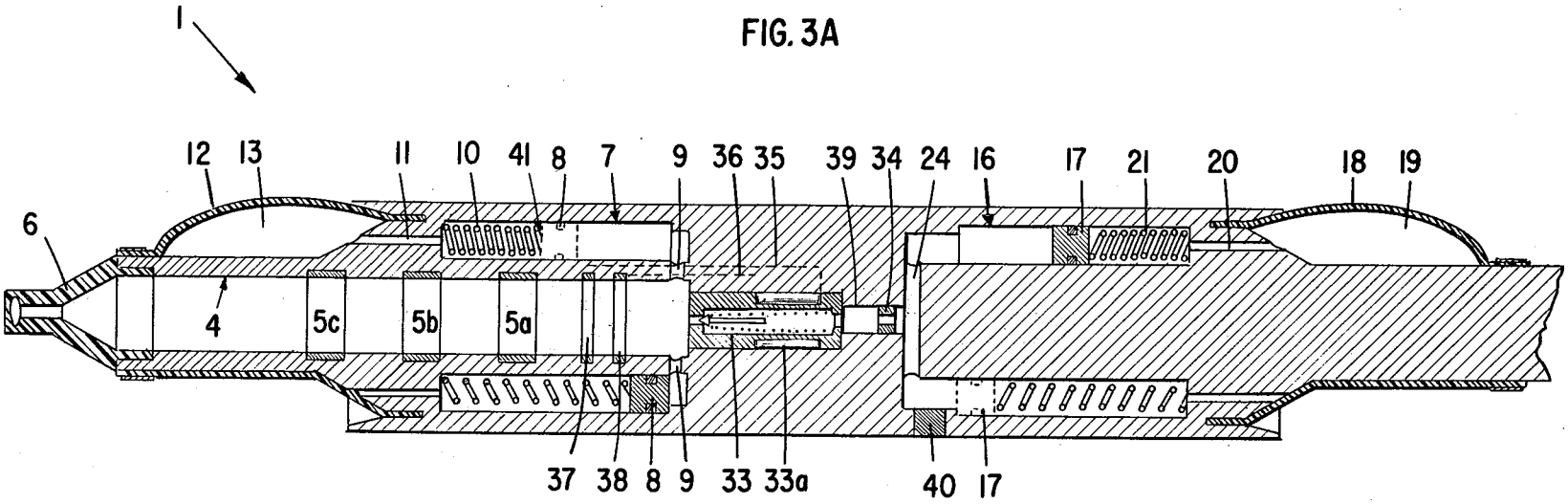
Figure 3B:
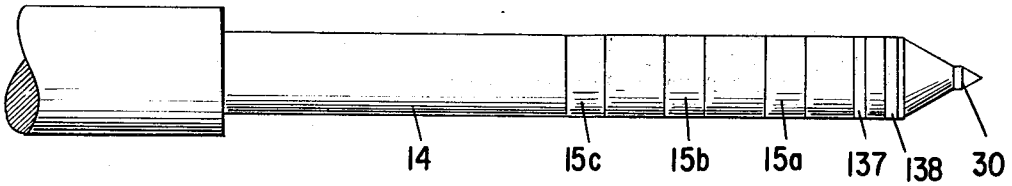

FIGS. 3A and 3B illustrate another embodiment of the invention wherein the means for transferring grease from the compensation chamber 16 to the bore 4 of the socket 1 comprises an electrically controlled valve 33. The latter is placed in series in a pipe 39 which connects the compensation chamber 16 with the bore 4. This electrically controlled valve comprises a control coil 33*a* connected with two electrical contacts 37 and 38 via two conductors 35 and 36. The plug 2 comprises two terminals 137 and 138 complementary to the electrical contacts 37 and 38. The duct 39 has a calibrated cross-section 34.

When the plug 2 is positioned in the socket 1, electric power is supplied to the winding 33*a* during a determined time interval $\Delta t$. This causes opening of the electrically controlled valve 33 and the required amount of grease is transferred from the chamber 16 to the bore 4. The amount of grease transferred is better controlled by the use of the calibrated cross-section 34.

In this embodiment, the electrically actuated valve 33 which is closed by gauged spring in the absence of any electric signal, also limits the pressure rise in the bore 4 as above indicated.

It would be obviously possible, without departing from the scope of the invention, to provide for the opening of duct 39 in the main chamber 7 and not in the bore 4, or to modify the embodiment illustrated in FIG. 2B so as to incorporate the electrically controlled valve, the compensating chamber and a duct having a calibrated cross-section in the plug 2.

It is also possible to provide a stop member 41 against which the piston 8 abuts after grease has been transferred from the compensation chamber to the assembly of the bore 4 and the main chamber 7, this stop member being so located as to stop the piston 8 when the volume of the chamber 7*a* filled with grease exceeds by a determined extent the volume of the bore 4. Thus it is not necessary to calibrate the duct 39 and during the grease transfer it is sufficient to remotely control the opening of the valve until the piston 8 reaches the stop member 41.

Figure 4A:
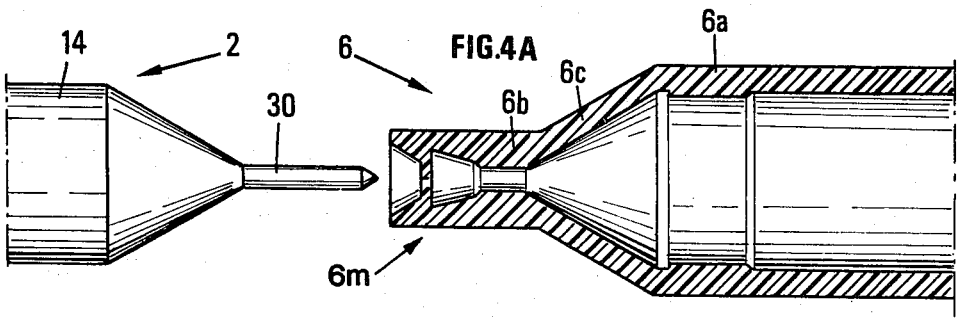

FIG. 4A is a cross-section of the obturator 6 located in the extension of the socket 1. This obturator is made of a resilient material having a high expansion coefficient such as, for example, but not limitatively, a neoprene having an expansion coefficient of from 500 to 600%.

This obturator comprises a cylindrical part 6*a* whose inner diameter is equal to those of the bore 4 and the socket 1. Reference 6*b* designates a second cylindrical part whose inner diameter is smaller than that of the bore 4 in a proportion compatible with the coefficient of expansion of the material constituting the obturator. The two cylindrical parts are interconnected by a conical part 6*c*.

Figure 4B:
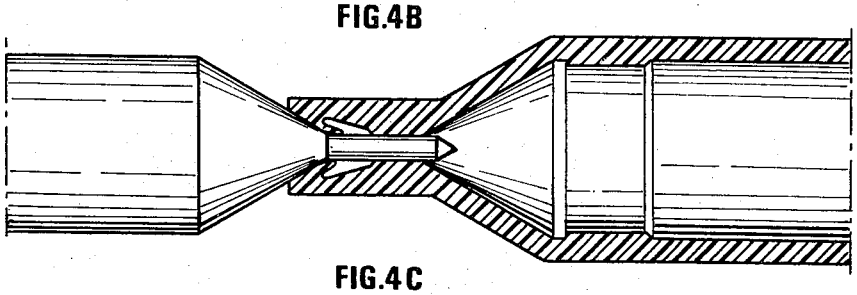
Figure 4C:
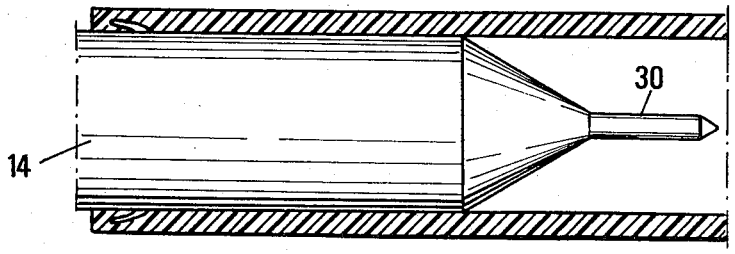
Figure 4D:
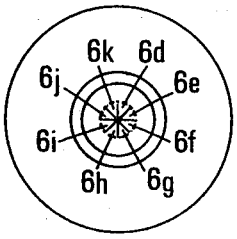

The free end of the obturator is closed by a diaphragm 6*m* perpendicular to the obturator axis and made by portions of circular sectors 6*d*, 6*e* . . . , these portions being contiguous, as shown in FIG. 4D which is a left side view of the embodiment of FIG. 4A.

When the plug 2 is inserted into the socket 1, the operating rod 30 repels the different portions 6*d* to 6*k* of the diaphragm and enters the portion 6*b* which provides for the sealing around the operating rod 30, as shown in FIG. 4B. Then the rod 2 causes expansion of the end of the obturator 6 and penetrates into the socket 1, the obturator 6 providing for the sealing of the cylindrical portion 14, as shown in FIG. 4C.

Changes or adaptations may be made by those skilled in the art without departing from the scope of the present invention.

For example, the connector may be provided with several pins, and the socket with several corresponding bores communicating, as above indicated, with at least one main chamber and at least one compensation chamber.

In the embodiment illustrated in FIGS. 1A and 1B the displacement of the piston 25 is achieved by means of an operating rod 30 located in the extension of the plug 2. However this operating rod could be replaced by an electromagnet acting on the piston 25. Moreover it is possible to make use of a solid piston 25, the valve 27 then being located in a duct opening in the bore 4 and in the channel 22 in the vicinity of the shoulder 29.

The invention has been described in its application to an electrical connector, only by way of example, but it is also applicable to any type of connector having two complementary parts mating each other, such as a mechanical locking or positioning connector.

What is claimed is:

1. A plug-in connector adapted for use in a fluid medium, comprising a socket having at least one bore; a plug provided with at least one pin for mating within said bore; a main chamber communicating with said bore and containing a protecting product and making up an assembly with said at least one bore, and the volume of said main chamber being automatically variable for filling said bore with protecting product as the pin is withdrawn from the bore; and said connector further comprising a compensation chamber filled with said protecting product under a pressure higher than that prevailing in said main chamber; and transfer means adapted for transferring a predetermined amount of said protecting product from said compensation chamber to said assembly formed by said main chamber and said bore of the socket to compensate for protecting product loss upon removal of said plug from said bore.

2. A plug-in connector according to claim 1, wherein said compensation chamber and said transfer means are incorporated into said socket of said connector.

3. A plug-in connector according to claim 1, wherein said compensation chamber and said transfer means are incorporated into said plug of said connector.

4. A plug-in connector according to claim 2 or 3, wherein said transfer means comprises a duct having a calibrated cross-section connecting said compensation chamber to the assembly formed by said main chamber and said bore of the socket, and a remotely actuated electrically controlled valve permitting the transfer of the protecting product through said duct having a calibrated cross-section.

5. A plug-in connector according to claim 2, comprising a communication duct connecting said compensation chamber with said assembly formed by said main chamber and said bore of said socket, a piston displaceable in said duct between two positions, the opposite sides of said piston communicating with a gauged valve for preventing the protecting product from flowing back into said compensation chamber, means for displacing said piston in said communication duct when said plug is inserted into said socket, and means for limiting the pressure prevailing in said main chamber.

6. A plug-in connector according to claim 5, wherein said means for displacing said piston comprises an operating rod located in the extension of said pin of the plug, with said operating rod penetrating into said communication duct for displacing said piston when the plug is inserted into the socket.

7. A plug-in connector according to claim 5, wherein said means for displacing said piston comprise a remotely controlled electro-magnet.

8. A plug-in connector according to claim 7, comprising a stationary non-return valve located between said communication duct and said compensation chamber to prevent said protecting product from flowing back into said compensation chamber.

9. A plug-in connector according to claim 3, wherein said plug is provided with a communication bore opening into said compensation chamber, a hollow piston displaceable between two positions in said communication bore, a hollow rod integral with said piston and opening at the end of said pin of said plug, said rod providing for a relative displacement of said hollow piston in its bore when said pin is inserted into the socket, a gauged valve housed in said hollow piston and preventing said protecting product from flowing into said compensation chamber, and means for limiting the pressure prevailing within said main chamber by releasing a possible excess amount of grease.

10. A plug-in connector according to claim 9, comprising a stationary non-return valve located between said communication bore and said compensation chamber for preventing said protecting product from flowing back into said compensation chamber.

* * * * *